US007718913B2

(12) United States Patent
Frigiere et al.

(10) Patent No.: US 7,718,913 B2
(45) Date of Patent: May 18, 2010

(54) ACTUATION BY CYLINDRICAL CAM OF A CIRCUIT-BREAKER FOR AN ALTERNATOR

(75) Inventors: Denis Frigiere, Decines (FR); Xavier Allaire, Chassieu (FR); Nicolas Chevillot, Villeurbanne (FR); Jean-Marc Willieme, La Mulatiere (FR)

(73) Assignee: Areva T&D SA, Paris, La Defense Cedex (FR)

( * ) Notice: Subject to any disclaimer, the term of this patent is extended or adjusted under 35 U.S.C. 154(b) by 505 days.

(21) Appl. No.: 11/820,829

(22) Filed: Jun. 21, 2007

(65) Prior Publication Data

US 2008/0011591 A1 Jan. 17, 2008

(30) Foreign Application Priority Data

Jun. 23, 2006 (FR) ..... 06 52628

(51) Int. Cl.
*H01H 33/02* (2006.01)

(52) U.S. Cl. ..... 218/2; 218/4; 218/6; 218/8; 218/10

(58) Field of Classification Search ..... 200/50.32, 200/50.37–50.39; 218/1–21
See application file for complete search history.

(56) References Cited

U.S. PATENT DOCUMENTS

| | | | | |
|---|---|---|---|---|
| 5,780,799 | A * | 7/1998 | David | 218/57 |
| 5,898,151 | A | 4/1999 | Plat et al. | |
| 5,905,242 | A | 5/1999 | Bernard et al. | |
| 5,952,635 | A | 9/1999 | Plat et al. | |
| 6,013,888 | A | 1/2000 | Thuries | |
| 6,593,538 | B2 * | 7/2003 | Perret et al. | 218/3 |
| 6,759,616 | B2 * | 7/2004 | Rokunohe et al. | 218/2 |
| 6,838,631 | B2 * | 1/2005 | Munakata et al. | 218/143 |
| 6,849,819 | B2 * | 2/2005 | Tresy et al. | 218/3 |
| 6,881,917 | B2 * | 4/2005 | Kikukawa et al. | 218/120 |
| 7,091,439 | B2 * | 8/2006 | Vaghini et al. | 218/154 |
| 7,199,324 | B2 | 4/2007 | Perret | |

FOREIGN PATENT DOCUMENTS

| | | | |
|---|---|---|---|
| DE | 893684 | | 10/1953 |
| DE | 10016950 | A1 | 10/2001 |
| EP | 0239783 | A2 | 10/1987 |
| EP | 0877405 | A1 | 11/1998 |
| EP | 0878817 | A1 | 11/1998 |
| EP | 1583124 | A1 | 10/2005 |
| EP | 1653491 | A2 | 5/2006 |
| FR | 2738389 | A1 | 3/1997 |

OTHER PUBLICATIONS

Specification for U.S. Appl. No. 12/161,314.
International Search Report, Application No. PCT/EP2007/050318, dated Apr. 27, 2007.
French Preliminary Report, Application No. FR 0652628, dated Feb. 28, 2007.
European Search Report, Application No. EP 07110719, dated Aug. 16, 2007.

* cited by examiner

*Primary Examiner*—Michael A Friedhofer
(74) *Attorney, Agent, or Firm*—Nixon Peabody LLP

(57) ABSTRACT

An alternator disconnector circuit-breaker of the invention includes a cylindrical cam (40) for optimizing the sequence for opening/closing the switch-over first switch (10), the circuit-breaker second switch (20), and the disconnector third switch (30). The cam (40) has a cylindrical wall in which three slots (42), and preferably three pairs of slots, of different shapes, are defined; an end element of an element driving a respective one of the switch contacts is mounted to slide in each slot.

17 Claims, 2 Drawing Sheets

ACTUATION BY CYLINDRICAL CAM OF A CIRCUIT-BREAKER FOR AN ALTERNATOR

CROSS-REFERENCE TO RELATED PATENT APPLICATION OR PRIORITY CLAIM

This application claims the benefit of a French Patent Application No. 06-52628, filed on Jun. 23, 2006, in the French Intellectual Property Office, the disclosure of which is incorporated herein in its entirety by reference.

FIELD OF THE INVENTION

The invention relates to the field of electrical apparatus equipping devices for delivering energy from alternators in power stations. The invention relates to actuating the various switch elements so that the alternator circuit-breakers are of simpler structure.

More particularly, the invention relates to an alternator circuit-breaker coupled to a disconnector, in which circuit-breaker the various relative movements of the contacts take place by means of a cylindrical cam making it possible to optimize the synchronization and the speed of separation of the contacts, while also maintaining the compactness of the circuit-breaker.

STATE OF THE PRIOR ART

At the outlet of the power station, e.g. for each alternator, one safety option is to dispose a circuit-breaker making it possible to isolate the circuit in question before the transformer connected to a power line. That type of switchgear, under a voltage in the range approximately 15 kilovolts (kV) to approximately 36 kV, then performs the functions of passing high permanent current (of the order of a few thousand amps) and of breaking high fault current (of the order of a few tens of thousands of amps), while isolating the circuit.

In view of the magnitude of the rated nominal current in the circuit, the circuit-breaking is performed in two stages by means of two switches in parallel, one of which passes the rated permanent current and the other of which breaks the short-circuit current, thereby defining a "main circuit" and an "auxiliary circuit".

The contacts of the switch of the main circuit for such alternator circuit-breakers are heavy enough to withstand high rated currents without overheating, and they define a relatively large volume. The circuit-breaker switch conventionally comprises a small-size chamber disposed inside said volume and having arcing contacts that are mounted to move relative to each other and that, de facto, withstand only the circuit-breaking current of the circuit-breaker.

Usually, firstly the main contacts move apart and travel sufficiently before the current switches over to the arcing contacts, which then open and cause the current to be broken.

It is usual for the alternator circuit-breaker to be associated with a disconnector, which has no circuit-breaking power: the disconnector opens only when the circuit-breaker is open and thus when current is no longer passing through the circuit. It is known that such a disconnector can be incorporated into the power station circuit-breaker that is described, for example, in Document EP 0 877 405.

The various breaking elements of such a disconnector circuit-breaker must be actuated in the above-mentioned order, while optimizing the separation speeds. Unfortunately, in view of the overall size and weight, not all solutions are feasible.

In particular, in the state of the art, actuation usually (EP 0 877 405) takes place via levers provided with springs, thus posing the problem of dimensioning the springs, and above all of fatigue and ultimate deterioration thereof.

Another option concerns implementing linkage guide systems (Document EP 0 878 817), which are, however, very difficult to design and very voluminous.

SUMMARY OF THE INVENTION

An object of the invention is to make alternator circuit-breakers more compact and more simple to make by means of a novel, common-control actuation system.

More particularly, in one of its aspects, the invention provides an alternator disconnector circuit-breaker comprising a change-over switch in parallel with a circuit-breaker switch, e.g. a vacuum chamber; each of the switches has a pair of contacts that are mounted to move relative to each other along a respective axis, by being actuated by actuator means. The circuit-breaker further comprises a disconnector switch advantageously in series in with the circuit-breaker switch, which disconnector switch comprises a pair of contacts that are mounted to move relative to each other, advantageously in translation, by being actuated by actuator means.

Preferably, the three axes along which the contacts move coincide. Usually, only one contact of each pair is a moving contact, the other contact being a stationary contact.

The actuator means for actuating one or more of the switches may be coupled to the corresponding contact via a connection rod, in order to leave a certain distance between the contacts.

The circuit-breaker further comprises synchronization means making it possible, while breaking, for the contacts to separate successively in the following order: the contacts of the change-over switch, then the contacts of the circuit-breaker switch, and then the contacts of the disconnector; the synchronization means also make it possible for the contacts to be re-closed in the reverse order. It is possible to make provision for the circuit-breaker switch to be closed at the end of the opening operation, in particular if it is a vacuum chamber. Advantageously, the synchronization means are coupled to the actuator means and make it possible, via common control means, to implement each of the switching operations.

In accordance with the invention, in order to make the circuit-breaker compact and in order to make the control simple, the actuation and synchronization means of at least the first and second switches comprise a cylindrical cam, i.e. a cylinder provided with slots that co-operate with slider elements making it possible to actuate the contacts. Preferably, the cylinder also actuates the disconnector. The cylinder is caused to move in rotation by an appropriate system, e.g. a transmission chain or a linkage actuated by a lever.

Each of the actuation and synchronization slots has a helical portion whose winding direction depends on the direction of the movement in translation of the contact in question, and whose slope depends on the relative separation speed of the contacts. In order to generate latencies between opening the contacts of the switches, the helical portions of the slots are offset relative to one another by the presence of zero-slope portions (i.e. portions extending around the cylinder orthogonally to the axis) or shallow-slope portions.

It is advantageous for the moving contact of at least one switch or preferably of all the switches to be actuated via a plurality of slider elements distributed around its periphery, e.g. two diametrically opposite elements; said slider elements can be coupled to the contact via rods, each having one end fastened to the contact and the other end carrying the slider element. Each slider element co-operates with a corresponding slot in the cylinder, the slots that make it possible to actuate a single contact being of similar shape but being offset around the periphery of the cylinder. If rods between slider element and contact are present, it is preferred for the plurality of actuating rods for actuating the same contact to be coupled together via a part guaranteeing that they remain in the correct geometrical positions, e.g. a bar.

In a preferred embodiment, the actuator means are guided in translation by the presence of studs co-operating with rectilinear grooves situated in the casing of the circuit-breaker. In particular, the slider elements are extended perpendicularly to the axis of movement by said studs.

BRIEF DESCRIPTION OF THE DRAWINGS

The characteristics and advantages of the invention will be better understood on reading the following description with reference to the accompanying drawings, which are given by way of non-limiting illustration, and in which.

DETAILED DESCRIPTION OF PARTICULAR EMBODIMENTS

Figure 1:
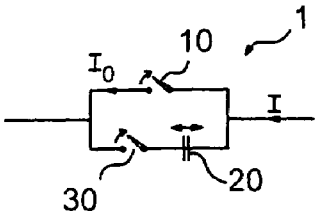
FIG. 1 diagrammatically shows the circuit-breaking principle of a disconnector circuit-breaker of the invention.

The operating principle of a circuit-breaker, and in particular of an alternator circuit-breaker 1 of the invention, is shown diagrammatically in FIG. 1, with a main circuit in which a current $I_0$ close to the rated current I flows when in operation, and an auxiliary circuit that is used for breaking a short-circuit.

For an alternator circuit-breaker, passing a current I of rated magnitude greater than a few thousand amps require a switch 10 whose contacts are particularly conductive, e.g. made of copper, to be used on the main circuit; the breaking power of those contacts is, however, limited due to electric arcs striking. A circuit-breaker second switch 20 is put in parallel with the first switch 10 in order to perform the circuit-breaking function proper. The first switch 10 opening causes, de facto, the current I to be switched over from the main circuit to the auxiliary circuit; the contacts of said second switch 20 that are, for example, made of tungsten, are of limited performance as regards passing the rated current I, but have high breaking power.

Thus, the functions of passing the permanent current and of breaking short-circuit current are separated: when such circuit-breaking is necessary, firstly the first switch 10 is activated, all of the current I then going over to the auxiliary circuit and causing the second switch 20 to be opened so as to obtain the circuit-breaking function. In addition, a third switch 30 is then opened: its function is mainly a safety function, its association on the auxiliary circuit making it possible to avoid a reduction in the dielectric strength of the second switch 20 that might accidentally allow current to pass into the associated branch.

In order to re-close such a circuit-breaker, the reverse order applies: firstly the disconnector 30 is re-closed, then the circuit-breaker switch 20 is re-closed, and finally the first switch 10 is re-closed.

Each of the switches 10, 20, 30 has a pair of contacts that are mounted to move relative to each other; advantageously, the first contact 12, 22, 32 of each pair is stationary, and the second contact 14, 24, 34 is a moving contact that is mounted to move relative to the first contact.

Figure 2A:
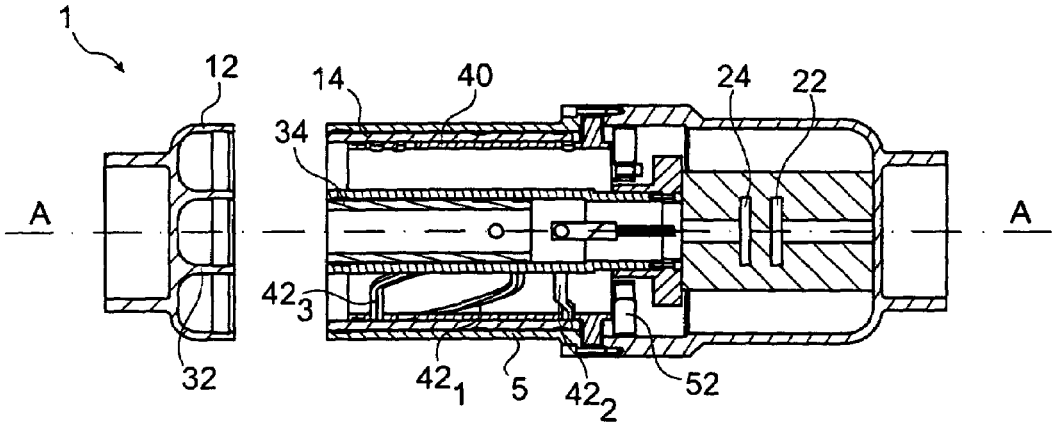
FIGS. 2A and 2B show a preferred embodiment of the circuit-breaker of the invention, in the fully-open position and in the fully-closed position.
Figure 2B:
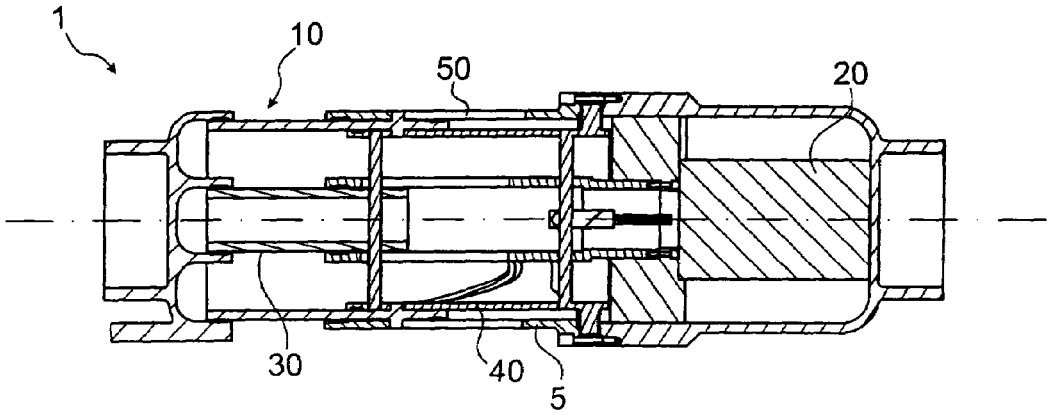

In particular, the first switch 10 can be of the gas type; it can also, if the rated current is very high, itself be switchgear comprising two switches put in parallel with each other. Preferably, however, as shown in FIGS. 2, the first switch 10 is an air-insulated switch having a stationary first contact 12 that is tubular about an axis AA and into which a second contact 14 that is also tubular can be inserted.

The second switch 20 can be a gas-insulated circuit-breaker containing a gas, e.g. the sulfur hexafluoride ($SF_6$); preferably, since the current $I-I_0$ passing through it is low under normal operating conditions, it is a vacuum chamber: this makes it possible to avoid using $SF_6$, thereby improving ecological performance and reducing costs.

Finally, the third switch 30 can have a stationary contact 32 into which another moving contact 34 of the rod type can be inserted along the opening/closure axis AA.

Preferably, the first and second switches have a common axis; such a common axis for the electrical circuits is favorable to switching over the current from the main circuit to the secondary circuit; the contacts of both switches thus extend along the same longitudinal axis and are moved in translation parallel to said axis AA. In the preferred embodiment, the contacts of the third switch 30 also move in translation and all three axes along which the contacts 14, 24, and 34 move coincide.

Pole operation of the disconnector circuit-breaker 1 is such that the contacts of each switch 10, 20, 30 are preferably driven by a common control coupled to the poles via a synchronization set of moving parts making it possible to guarantee that the operating sequence takes place in the proper order.

According to the invention, each moving contact 14, 24, 34 is actuated via an actuation and synchronization device using a rotary cam system located in a casing 5 of the circuit-breaker 1. This solution makes it possible to determine the movement of each switch 10, 20, 30 in a common-axis construction which facilitates compactness, which is easy to design, and which is robust over time; the cam system 40 is located inside the existing circuit-breaker 1 without reducing its compactness.

In particular, the actuation and synchronization means comprise a cylinder 40 that is preferably circularly symmetrical about the axis AA of movement in translation of the contacts 14, 24, 34 of the circuit-breaker 1.

Slots 42 are machined in the wall of the cylinder 40, at least one slot being provided for each contact to be actuated: a first slot $\mathbf{42}_1$ serves to actuate opening and/or closing of the main first switch 10, a second slot $\mathbf{42}_2$ serves to actuate opening and/or closing of the secondary second switch 20, and a third slot $\mathbf{42}_3$ serves to actuate the disconnector switch 30. The shapes of the slots 42 make it possible to synchronize the movements, and to determine the relative speeds of the movements in translation.

Figure 3A:
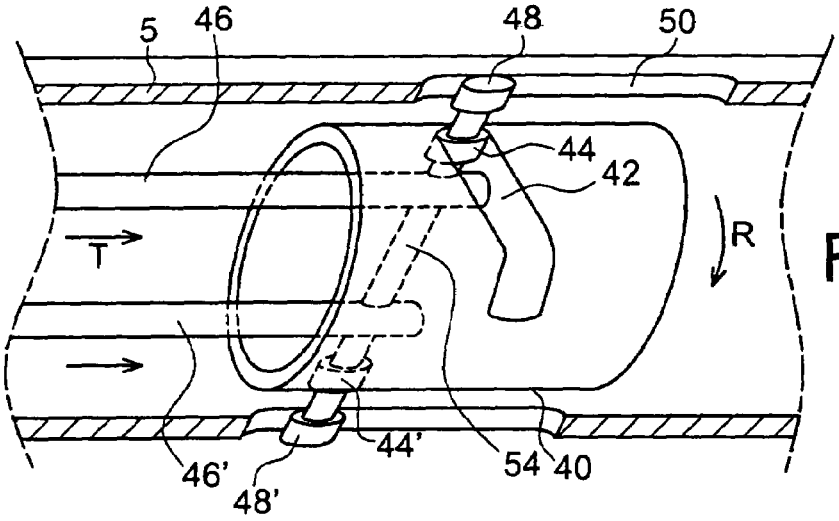
FIGS. 3A and 3B diagrammatically show two elements that are part of actuation and synchronization means of the invention.

Each of the switches is actuated via an element 44 suitable for sliding in the corresponding slot 42 in the cylinder 40 and secured firmly to the contact; if the contact is remote from the cylinder 40, the slider element 44 can be coupled at one end to a connection rod 46 which is firmly secured via its other end to the contact; for reasons of clarity, it is this embodiment that is shown in FIG. 3A, but it should be understood that, in most cases and for reasons of compactness, the connection rod 46 is absent and the slider elements 44 are integral parts of the contact to be moved.

Thus, while the cylinder 40 is moving in rotation (arrow R), due to the shape of the slot 42, the slider element 44 moves in the slot 42 and the contact is driven in translation (arrow T), e.g. via the rod 46.

Preferably, the contact, the slider elements 44 and/or the connection rods 46 are located inside the actuation and synchronization rotary cylinder 40: the shape of each of the slots 42 can thus be more precise in view of the larger diameter of the cylinder 40, which is also more robust.

In order to avoid any torsion force on the contact, and in particular any interference rotation from a rod 46, the slider element 44 itself is preferably guided in translation, or the connection rod 46 is guided longitudinally. Advantageously, the guidance is achieved by co-operation between a stud 48 that is integral with the slider element 44 and/or with the rod 46, and a groove 50 parallel to the axis of movement in translation AA of the contact, e.g. located in the casing 5 of the circuit-breaker 1. In particular, the slider element 44 mounted to slide in the slot 42 in the cylinder 40 can be extended outwards by a stud 48 mounted to slide in a groove 50 in the casing 5.

The actuation and synchronization slots are shaped so as to control the characteristics of speed and of synchronization between the movement of each of the switches 10, 20, 30.

Figure 3B:
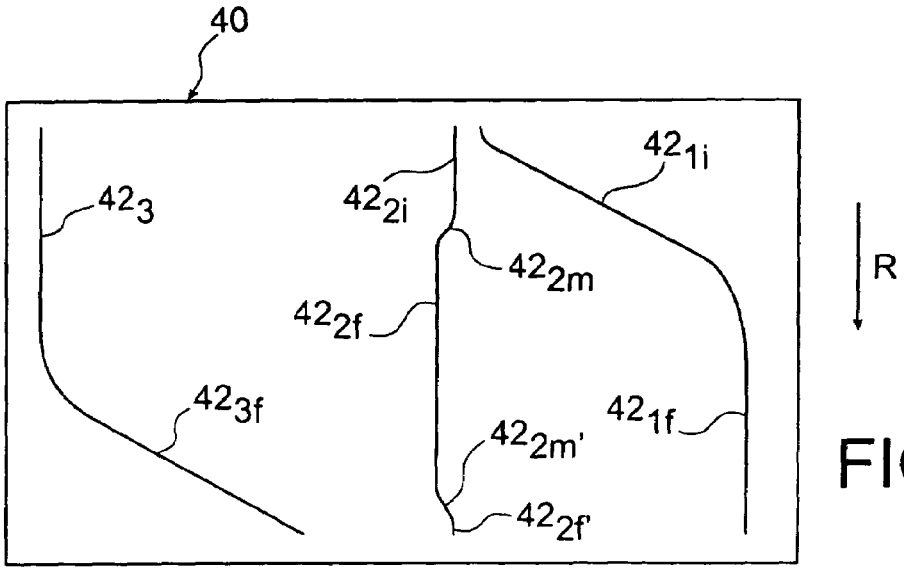

Thus, for example, in a preferred example that is shown, the cylinder 40 is located between the first and second contacts 14, 24 which move in opposite directions, the disconnector 30 being moved similarly to the first switch 10. One configuration for the slots 42 is shown in FIG. 3B, in an "unrolled" version of the cylinder 40.

The first slot $\mathbf{42}_1$ of the cylinder 40 comprises an initial end portion $\mathbf{42}_{1i}$ which is helical in a first direction: as soon as the cylinder 40 is actuated R, the first contact 14 of the first switch 10 is urged to move in translation for separation purposes so as to break the current as quickly as possible. The slope of the first slot $\mathbf{42}_1$ depends on the relative speed T to be obtained as a function of the rotation speed R imparted to the cylinder 40 by its control means 52.

Once the contacts of the first switch 10 are open, it is no longer necessary to actuate them, and advantageously the first slot $\mathbf{42}_1$ includes a final end portion $\mathbf{42}_{1f}$ which is rectilinear, and normal to the axis AA. It is also possible to make provision for a slower movement in translation by changing the slope, or for a reverse movement.

The second slot $\mathbf{42}_2$ has an initial end portion $\mathbf{42}_{2i}$ which is not sloping but rather it is linear along a perimeter of the wall: during a first stage after actuation, the second switch 20 is not switched; on the contrary, it remains closed so that the current passes from the main circuit to the auxiliary circuit. By means of the shape of the initial end portion $\mathbf{42}_{2i}$ of the second slot, the cylinder moving in rotation does not, in a first stage, cause any movement in translation of the slider element 44 and thus of the second contact 24.

Once the contacts of the first switch 10 are separated, it is necessary to open the secondary switch 20: after the initial end portion $\mathbf{42}_{2i}$, the second slot $\mathbf{42}_2$ is extended by a helical middle portion $\mathbf{42}_{2m}$ whose slope depends on the relative speed of opening of the switch 20. In the context shown, the winding direction of the second slot $\mathbf{42}_{2m}$ is the reverse of the winding direction of the initial end portion $\mathbf{42}_{1i}$ of the first slot, the two contacts 14, 24 moving in opposite directions; this is merely an example given by way of illustration. The length of the initial end portion of the second slot $\mathbf{42}_{2i}$ depends on the latency time before the second switch 20 is actuated; preferably the sector covered by the second initial end portion $\mathbf{42}_{2i}$ is smaller than the sector covered by the first initial end portion $\mathbf{42}_{1i}$, sufficient opening of the main switch 10 being just defined to enable the vacuum chamber 20 to be opened without a risk of an electrical arc striking. In addition, in view of the dimensions when a vacuum chamber 20 is used, it should be noted that the length of the middle portion $\mathbf{42}_{2m}$ of the slot is very small, the distance of separation of the contacts 22, 24 being small.

In the same way, actuation of the third contact 34 is offset relative to the movement of the second contact 24: the third slot $\mathbf{42}_3$ has a linear initial end portion $\mathbf{42}_{3i}$ that is longer than the initial end portion $\mathbf{42}_{2i}$ of the second slot and than the middle portion $\mathbf{42}_{2m}$ of said second slot, de facto determined to be greater than the distance corresponding to the maximum arcing time; it is naturally possible instead to impart a "slow" movement in translation. Helical winding of the third slot $\mathbf{42}_{3f}$ is then provided, in the direction of winding of the first slot $\mathbf{42}_{2i}$ for this embodiment in which the disconnector 30 and first switch 10 operate "in the same direction" even though the reverse would be possible. In this example too, it is advantageous for the final end portion $42_{2f}$ of the second slot to be linear and for the contacts 22, 24 to cease moving (at least for a certain time) once opening is achieved.

Through the choice of the slope of each of the windings $\mathbf{42}_{1i}$, $\mathbf{42}_{2m}$, $\mathbf{42}_{3f}$ it is possible to adjust the speed of separation of the contacts without modifying the speed of rotation of the cylinder 40; the control means can thus be simplified, and the cylindrical cam 40 can be moved in rotation by any suitable system 52, e.g. by insulating links mounted on a lever, or by a system of drive chains.

Through the choice of the shapes for the slots 42, it should be noted that the closure sequence is also complied with.

It is possible to adapt the shapes to the desired sequences, and, for example, to provide opening in two stages, or to design more than two or three portions for each of the slots $\mathbf{42}_1$, $\mathbf{42}_2$, $\mathbf{42}_3$. In particular, and as shown in FIG. 3B, it is possible, in order to protect it, to re-close the vacuum chamber 20 once the disconnection has been performed. To this end, the "final" end portion $\mathbf{42}_{2f}$ of the second slot is de facto extended by a second middle portion $\mathbf{42}_{2m'}$, of direction opposite from the direction of the middle portion $\mathbf{42}_{2m}$, and which makes it possible to re-close the contacts 22, 24 of the vacuum chamber; a second final linear portion $\mathbf{42}_{2f}$ can also be provided.

In addition, the cam-driven control and synchronization can be chosen to actuate the first two switches 10, 20 only, if, for example, a "knife-switch" disconnector 30 is chosen.

In an advantageous embodiment (shown in a particular configuration in FIG. 3A) in order to balance the forces on a contact, two slider elements 44, 44' are secured thereto in diametrically opposite manner, and they slide in a corresponding slot of the cylinder 40: the cylinder then has a pair of first, of second and/or of third slots 42, 42', each slot of the pair being identical and offset by 180° relative to the other slot in the pair. In which case, and preferably, each slider element 44, 44' is provided with a guide stud 48, 48' for guiding in a slot 50, 50' opposite from the casing 5 of the circuit-breaker 1.

In particular, if the contact is remote from the actuator cylinder 40, each slider element 44, 44' can be connected to the contact via a rod 46, 46'. Advantageously, the ends of the rods 46, 46' that are provided with the slider elements 44, 44' are connected together, inside the cylinder 40, by an orthogonal bar 54 that keeps them apart and holds them in position in order to limit the forces.

It is understood that the embodiment with two slider elements 44, 44' is given by way of example, and that is possible, for example, to design a plurality of elements distributed uniformly or otherwise, over the periphery of the contact.

Preferably, every one of the switches or each of only some of them can be provided with two slider elements. In an advantageous embodiment, only one of the switches, e.g. the vacuum chamber, is actuated via the actuator rods, which are optionally interconnected by bars.

By means of the actuation of the invention, it is possible to control the various opening/closure movements of the switches 10, 20, 30 independently from one another. In addition, unlike the spring, this control is not degraded over time. The cam-driven actuation 40 also makes it possible to keep the pole of the circuit-breaker 1 compact, the cylinder 40 lying within the usual circuit-breaker 1. The circuits can thus continue to have a common axis, even though it is possible, in particular by implementing an actuator rod 46 external to the cylinder 40, to use a disconnector circuit-breaker having intersecting axes, as presented in Application EP 0 878 817.

The invention claimed is:

1. An alternator disconnector circuit-breaker comprising:

a first switch having a first pair of contacts that are mounted to move relative to each other in translation along a first axis;

a circuit-breaker second switch having a second pair of contacts that are mounted to move relative to each other in translation along a second axis, the second switch being put in parallel with the first switch;

a disconnector third switch having a third pair of contacts mounted to move relative to each other;

actuator means for actuating a contact of each switch; and synchronization means making it possible, while breaking, for the contacts of the first switch to separate before the contacts of the second switch separate, said contacts of the second switch themselves separating before the third contacts separate fully;

said circuit-breaker being characterized in that:

the actuator means of the first and second switches and the synchronization means are coupled together and comprise a cylinder mounted to move in rotation about an axis and presenting in its wall at least first and second slots that are helical in part;

the actuator means of the first switch comprise at least a first slider element mounted to slide in a first slot and secured firmly to a contact of the first switch;

the actuator means of the second switch comprise at least one second slider element mounted to slide in a second slot and secured firmly to a contact of the second switch.

2. A circuit-breaker according to claim 1, wherein the first axis of movement in translation, the second axis of movement in translation, and the axis of rotation of the cylinder coincide.

3. A circuit-breaker according to claim 1, wherein the third switch is in series with the second switch, and the resulting set of switches is in parallel with the first switch.

4. A circuit-breaker according to claim 1, wherein the contacts of the third switch are mounted to move in translation along a third axis.

5. A circuit-breaker according to claim 4, wherein all four axes coincide.

6. A circuit-breaker according to claim 4, wherein the cylinder presents a third slot that is helical in part, and at least a third slider element is fastened to a contact of the third switch and slides in the third slot, the synchronization and actuation means of the three switches being coupled together.

7. A circuit-breaker according to claim 1, wherein the slider elements of at least two switches are located inside the cylinder.

8. A circuit-breaker according to claim 1, wherein the cylinder presents two first, two second, and/or two third slots having the same shape and offset by 180° relative to each other about the axis of the cylinder, and wherein the first, the second and/or the third contact is secured firmly to two first, two second and/or two third slider elements which are mounted to slide in the two first, two second, and/or two third slots.

9. A circuit-breaker according to claim 8, wherein the two slider elements are fastened to at least one contact via a connection rod and further comprising a connection bar interconnecting the two connection rods inside the cylinder.

10. A circuit-breaker according to claim 1, wherein at least one slider element is fastened to the contact in question via a connection rod.

11. A circuit-breaker according to claim 1, further comprising holding means for holding at least one contact parallel to its axis of movement.

12. A circuit-breaker according to claim 11, wherein the holding means are constituted by guide grooves in a casing of the circuit-breaker.

13. A circuit-breaker according to claim 1, wherein the shape of each slot has at least two portions having different slopes relative to the axis (AA) of the cylinder.

14. A circuit-breaker according to claim 13, wherein the helical portion of the second slot lies between an initial end portion and a final end portion of slopes greater than the slopes of the helical portion relative to the axis.

15. A circuit-breaker according to claim 1, wherein the winding direction of the helical portions of the first and second or third slots are opposite.

16. A circuit-breaker according to claim 1, further comprising control means for controlling the cylinder, preferably selected from a drive chain and drive links.

17. A circuit-breaker according to claim 1, wherein the second switch is a vacuum chamber.

* * * * *